United States Patent [19]

Hunyar et al.

[11] 4,363,705

[45] Dec. 14, 1982

[54] PASSIVATING AND SILVER REMOVAL METHOD

[75] Inventors: Csaba K. Hunyar, Glendale; Gary A. Hand, Azusa, both of Calif.

[73] Assignee: Capitol Records, Inc., Hollywood, Calif.

[21] Appl. No.: 284,052

[22] Filed: Jul. 16, 1981

[51] Int. Cl.[3] ..... C25D 1/22

[52] U.S. Cl. ..... 204/5; 204/12

[58] Field of Search ..... 204/5, 12, 4

[56] References Cited

U.S. PATENT DOCUMENTS

| | | | |
|---|---|---|---|
| 1,531,140 | 3/1925 | Schneider | 204/5 |
| 2,530,842 | 11/1950 | Ruggieri | 204/5 |
| 2,758,961 | 8/1956 | Kosowsky | 204/5 |
| 3,186,932 | 6/1965 | Gelfand et al. | 204/216 |
| 4,188,240 | 2/1980 | Yoshio | 204/5 |
| 4,190,503 | 2/1980 | Ikeda | 204/5 |

*Primary Examiner*—T. Tufariello

*Attorney, Agent, or Firm*—Lyon & Lyon

[57] ABSTRACT

In the production of records, a mother is formed from a metal master having a nickel core and a silver coating. To produce the mother, the silver coating is removed from the nickel core and the nickel is passivated by treating the metal master with an aqueous solution containing ammonium persulphate. The same aqueous solution can be used for passivating the mother before the mother is electroplated to form a stamper.

11 Claims, No Drawings

PASSIVATING AND SILVER REMOVAL METHOD

BACKGROUND

The present invention is directed to electroplating processes, and in particular, processes used to manufacture the mother and stamper in the manufacture of phonograph records.

In manufacturing records, the original recording is cut with a diamond or sapphire stylus in lacquer, forming a lacquer master. The lacquer is sprayed with silver to make it electrically conductive, and then electroplated with nickel. The nickel and silver are separated from the lacquer, forming a metal master.

The metal master is then treated to remove the silver and passivate the nickel. Then another layer of nickel is plated on the face of the metal master. Because the metal master has been passivated, it is possible to mechanically separate the metal master from the second layer of nickel, which is called a "mother".

The mother is passivated, and then plated with a layer of nickel. This layer of nickel is separated from the mother and serves as a "stamper". The stamper is used for forming records on vinyl discs formed of vinyl chloride acetate copolymer.

The passivation process must not interfere with the replication of the surface being replicated. Passivation has been achieved by chemical means by either using potassium dichromate or chromic acid. However, both of these chemicals are hazardous, poisonous, and environmentally objectionable since they contain chromium.

Another passivation technique is electrolytic passivation. This is accomplished by making the part to be replicated anodic in a chemical solution by the application of direct current. Some of the chemicals used in this process, however, can be unacceptable in that they are poisonous and hazardous. Further, electrolytic passivation is a difficult process to control, being very dependent on chemical concentration and length of time of passivation.

Further, for both electrolytic passivation and chemical passivation techniques, the chemicals used are expensive and thus often reused. This can introduce contamination, corrosion, and other defects.

In view of these problems, it is apparent that there is a need for a passivation method that does not use expensive, hazardous, environmentally objectionable chemicals, and that passivates nickel surfaces without requiring precise process control.

SUMMARY

The present invention is directed to a passivation method which has these features. Further, the passivation method can be used for simultaneously passivating a metal master and removing the silver coating therefrom.

To produce a nickel image of a nickel plate in accordance with the present invention, an aqueous solution containing a persulphate composition is applied to the surface of the nickel plate. The aqueous solution contains the persulphate composition in an amount of at least 0.01 gram per liter of solution, and preferably less than about 500 grams per liter of solution. The persulphate composition is selected from the group consisting of ammonium and alkali metal persulphates and combinations thereof, and preferably is ammonium persulphate. The aqueous solution can also contain sufficient water soluble base, such as ammonium hydroxide, that the solution has a pH greater than 7. With this passivation method, a nickel image electroplated onto the passivated nickel plate is easily removed.

The method is also useful for producing a nickel image of a metal plate having a nickel core and a silver coating on at least a portion thereof, such as the metal master formed when producing records. The same aqueous solution containing a persulphate composition is applied to the metal plate. This simultaneously removes the silver coating and passivates the nickel core. Thereafter, the passivated nickel core can be electroplated with nickel.

These and other features, aspects, and advantages of the present invention will become better understood with reference to the following description and appended claims.

DESCRIPTION

The present invention will be described herein with regard to methods for producing phonograph records. However, it is to be appreciated that the passivating and silver removing method described can be used when producing an image or replication of any metal part.

As used herein, the term to "passivate" means to treat a metal surface so that a metallic coating can be applied to the treated surface and subsequently be removed therefrom. It is believed that the passivating aqueous solution of the present invention passivates a nickel surface by forming a conductive oxide layer on the surface.

The principal steps involved in the production of a record are:

1. Produce the lacquer master;
2. Produce the metal master;
3. Produce the mother;
4. Produce the stamper; and
5. Manufacture the vinyl records.

1. Lacquer Master

The lacquer master is formed in accordance with conventional techniques. An uneven surface is given to the lacquer master with a diamond or sapphire stylus.

2. Metal Master

To form the metal master, the lacquer master is coated with silver in a thickness of about 800 angstroms using a spray. The silver coating can be applied by techniques other than spraying such as brushing on a chemical solution or sputtering techniques. The silver coating is applied to make the lacquer master electrically conductive.

The silver coated lacquer master is then coated with nickel in a nickel plating solution. A variety of plating solutions are commercially available. Such solutions generally contains sufficient nickel sulphamate $[(NH_2SO_3)_2Ni]$ to yield from about 10 to about 12 ounces of nickel per gallon of solution. The plating solution can also contain boric acid in an amount of from about 4 to about 6 ounces by weight per gallon, and $\frac{1}{2}$ to 2 ounces by weight of chloride and/or bromide per gallon. The chloride and/or bromide can be provided in the form of nickel and/or magnesium salts. The plating solution can also contain an anti-pitting agent, such as a detergent, for reducing the surface tension so that any hydrogen generated can escape.

The actual plating occurs in two steps, a pre-plating step at a temperature of about 105° to 110° F. for 30 minutes using 10 to 20 amps filtered direct current. Immediately after preplating, the final plating occurs in an agitated tank using the same solution at a temperature of from about 115 to about 120° F. for 1¼ hours. Filtered DC current gradually increased from 20 about 200 amps is used.

The plated lacquer master is then rinsed with water, dried, and then the metal master is separated from the lacquer master. The metal master comprises a nickel core and a silver coating. It is trimmed to size. Any impurities transferred to the metal master from the lacquer master are removed with an organic solvent such as a ketone.

The metal master is then cleaned with a soap solution which can be applied by brush, spray or dipping. A satisfactory solution uses a detergent such as Enthone Enbond 160 available from Enthone of Long Beach, Calif. Any residual solution is rinsed off with distilled or deionized water.

3. Mother

To prepare the mother, the silver coating is removed from the metal master and the nickel core of the metal master is passivated simultaneously in a single operation. In this operation, an aqueous passivating solution containing a persulphate composition is applied to the metal master. The persulphate composition contains a water soluble persulphate selected from the group consisting of ammonium and alkali metal persulphates and combinations thereof. Suitable alkali metal persulphates are sodium, potassium, and lithium persulphate. Preferably ammonium persulphate is used because it complexes with the silver removed from the metal master, thereby preventing the silver from redepositing onto the nickel core.

As little as 0.01 gram of ammonium persulphate per liter of aqueous solution provides the necessary desilvering and/or passivation required. Preferably the aqueous solution contains less than about 500 grams of persulphate composition per liter because little, if any benefit, results from higher concentrations.

Preferably the aqueous passivating solution contains sufficient water soluble base that the solution has a pH greater than 7. This results in better cleaning and wetting of the metal master. Suitable bases include lithium hydroxide, potassium hydroxide, sodium hydroxide and ammonium hydroxide. Preferably ammonium hydroxide is used since the ammonium ion can complex with silver removed from the metal master. Ammonium hydroxide (28 Baume) can be used in an amount of from about 1 to about 500 grams per liter. A preferred passivating aqueous solution contains from about 100 to about 300 grams of ammonium persulphate and from about 100 to about 300 milliliters ammonium hydroxide solution (28 Baume) per liter of solution. This preferred solution is both economical to use and attains excellent silver removal and passivating results.

A satisfactory persulphate containing aqueous solution comprises 100 grams of ammonium persulphate, 100 milliliters 28 Baume ammonium hydroxide solution, and 400 mililiters of water.

The amounts of ammonium hydroxide used as presented herein are based upon 28 Baume ammonium hydroxide solution. If a different concentration of ammonium hydroxide in water is used for forming the passivating solution, the amount of ammonium hydroxide solution to be added to the passivating solution is varied accordingly.

The aqueous solution can be applied to the part to be treated by rotating the part on a turntable at approximately 60 rpm, at a slanted angle to permit drainage of spent solution from the surface. An airless spray for 20 to 30 seconds per part at a rate of 100 milliliters per minute can be used. The aqueous solution can also be applied by dipping the part in the solution or brushing or spraying the solution onto the part.

Treatment with the solution results in removal of the silver and passivation of the nickel of the metal master. The treated part is then spray rinsed using distilled or deionized water by using a high pressure (50 to 60 psi) spray for approximately 15 seconds. The resultant part is then suitable for forming the mother record.

The mother record is formed by electroplating the passivated metal master using the same plating solution used for forming the metal master. The plating takes place at about 125° F. for 1¼ hours using 200 amps filtered direct current. The electrically plated part is then rinsed with distilled or deionized water, dried, and the mother is separated from the metal master. While the metal master was a "negative" of the grooves formed on the lacquer master, the mother is a "positive" of the lacquer master, i.e., its grooves are the same as these of the lacquer master.

4. Stamper

The stamper is prepared from the mother using substantially the same technique used for preparing the mother from the metal master. The mother is:

(a) Cleaned with a soap solution;
(b) Rinsed with distilled and/or deionized water;
(c) Passivated with the persulphate containing aqueous solution;
(d) Rinsed with distilled or deionized water; and
(e) Plated with nickel using the same nickel plating solution and same technique used for plating the metal master.
(f) Then the stamper is separated from the mother.

5. Vinyl Records

The stamper, which is a "negative" of the lacquer master, is impressed into hot molten vinyl discs, thereby forming a "positive" record.

Substantial advantages result from using the passivating/silver removing persulphate containing solution of the present invention. The chemicals used are environmentally safe, not containing heavy metals, thereby minimizing hazards present in the process. In addition, the concentrations of the constituents of the persulphate containing solution are not critical. Therefore, application of the solution to the part to be treated is simple with a wide latitude of margin. This is in contrast to existing chemical or electrical passivation methods where error in the length of time of exposure or error in the concentration of the chemicals can create corrosion and pitting problems, or only local adhesion.

An additional advantage of the method and passivating solution of the present invention is that not only can a part be passivated, but in addition, silver present on the part can be removed simultaneously. This eliminates the extra chemicals and processing steps required for silver removal.

A further advantage is that unlike some chemical passivating methods, in particular methods using potassium dichromate, a strong cleaning effect on the surface being passivated occurs. Therefore, cleaning is integrated into the passivating process.

Although the present invention has been described in considerable detail with reference to certain preferred versions thereof, other versions are possible. Therefore the spirit and scope of the appended claims should not necessarily be limited to the description of the preferred versions contained herein.

What is claimed is:

1. In a method for producing a nickel image of a nickel plate comprising the step of plating the nickel plate with a nickel containing solution, the improvement comprising of step of applying to the surface of the nickel plate, before the step of plating, an aqueous solution containing a water soluble persulphate composition in an amount of at least 0.01 gram per liter of solution, the persulphate composition being selected from the group consisting of ammonium and alkali metal persulphates and combinations thereof.

2. A method for producing a nickel image of a metal plate having a nickel core and a silver coating on at least a portion of the core, the method comprising the steps of:

(a) applying to the surface of the plate an aqueous solution containing a water soluble persulphate composition in an amount of at least 0.01 gram per liter of solution, the persulphate composition being selected from the group consisting of ammonium and alkali metal persulphates and combinations thereof, wherein a sufficient amount of the aqueous solution is applied for simultaneously removing the coating and passivating the nickel core; and (b) thereafter plating the passivated nickel core with nickel.

3. The method of claim 1 or 2 in which the persulphate composition is ammonium persulphate.

4. The method of claim 1 or 2 in which the aqueous solution contains the persulphate composition in an amount of less than about 500 grams per liter.

5. The method of claim 1 or 2 in which the aqueous solution comprises a water soluble base in an amount sufficient that the aqueous solution has a pH greater than 7.

6. The method of claim 5 in which the base is ammonium hydroxide.

7. The method of claim 6 in which the aqueous solution contains ammonium hydroxide in an amount corresponding to from about 1 to about 500 milliliters 28 Baume per liter.

8. A method for producing a nickel stamper from a nickel mother for the manufacture of records comprising the steps of:

(a) selecting a nickel mother;

(b) passivating the surface of the nickel mother by applying to the nickel mother an aqueous solution containing ammonium persulphate in an amount of from about 0.01 to about 500 grams per liter of solution and sufficient Ammonium hydroxide that the aqueous solution has a pH greater than 7;

(c) electroplating the passivated mother, thereby forming the nickel stamper; and (d) separating the nickel stamper from the nickel mother.

9. A method for producing a nickel mother from a metal master, the metal master having a nickel core and a silver coating on at least a portion of the core, the method comprising the steps of:

(a) simultaneously removing the silver coating and passivating the nickel core by applying to the surface of the metal master an aqueous solution containing ammonium persulphate in an amount of from about 0.01 to about 500 grams per liter of solution and sufficient ammonium hydroxide that the aqueous solution has a pH less than 7;

(b) electroplating the passivated nickel surface of the metal master thereby forming the nickel mother; and (c) separating the nickel mother from the metal master.

10. In a method for producing a metal image of a metal plate comprising the step of plating the metal plate with a solution containing a selected metal, the improvement comprising the step of applying to the surface of the metal plate, before the step of plating, an aqueous solution containing a water soluble persulphate composition in an amount of at least 0.01 gram per liter of solution, the persulphate composition being selected from the group consisting of ammonium and alkali metal persulphates and combinations thereof.

11. The method of claim 10 in which the persulphate composition is ammonium persulphate.

* * * * *